US006023671A

United States Patent [19]

Iijima et al.

[11] Patent Number: 6,023,671

[45] **Date of Patent: *Feb. 8, 2000**

[54] VOICED/UNVOICED DECISION USING A PLURALITY OF SIGMOID-TRANSFORMED PARAMETERS FOR SPEECH CODING

[75] Inventors: Kazuyuki Iijima, Saitama; Masayuki Nishiguchi, Kanagawa; Jun Matsumoto, Kanagawa; Shiro Omori, Kanagawa, all of Japan

[73] Assignee: Sony Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/833,970

[22] Filed: Apr. 11, 1997

[30] Foreign Application Priority Data

Apr. 15, 1996 [JP] Japan ..... 8-092848

[51] Int. Cl.[7] ..... G10L 9/00

[52] U.S. Cl. ..... 704/214; 704/208

[58] Field of Search ..... 704/204, 208, 704/214, 220, 222

[56] References Cited

U.S. PATENT DOCUMENTS

| | | | |
|---|---|---|---|
| 4,219,695 | 8/1980 | Wilkes et al. | 704/217 |
| 4,797,926 | 1/1989 | Bronson et al. | 704/214 |

OTHER PUBLICATIONS

Bishnu S. Atal and Lawrence R. Rabiner, "A Pattern Recognition Approach to Voiced–Unvoiced–Silence Classification with Applications to Speech Recognition," IEEE Trans. Acoustics, Speech, and Signal Processing, vol. ASSP–24, No. 3, pp. 201–212, Jun. 1976.

Leah J. Siegel, "A Procedure for Using Pattern Classification Techniques to Obtain a Voiced/Unvoiced Classifier," IEEE Trans. Acoustics, Speech, and Signal Processing, vol. ASSP–27, No. 1, pp. 83–88, Feb. 1979.

Leah J. Siegel and Alan C. Bessey, "Voiced/Unvoiced/Mixed Excitation Classification of Speech," IEEE Trans. Acoustics, Speech, and Signal Processing, vol. ASSP–30, No. 3, pp. 451–460, Jun. 1982.

*Primary Examiner*—David R. Hudspeth
*Assistant Examiner*—Tálivaldis Ivars Šmits
*Attorney, Agent, or Firm*—Jay H. Maioli

[57] ABSTRACT

A method and apparatus for voiced/unvoiced decision for judging whether an input speech signal is voiced or unvoiced. The input parameters for performing the voiced/unvoiced (V/UV) decision are comprehensively judged in order to enable high-precision V/UV decision by a simplified algorithm. Parameters for the voiced/unvoiced (V/UV) decision include the frame-averaged energy of the input speech signal lev, the normalized autocorrelation peak value r0r, the spectral similarity degree pos, the number of zero crossings nZero, and the pitch lag pch. If these parameters are denoted by x, these parameters are converted by function calculation circuits using a sigmoid function g(x) represented by $$g(x)=A/(1+\exp(-(x-b)/a))$$

where A, a, and b are constants differing with each input parameter. Using the parameters converted by this sigmoid function g(x), the voiced/unvoiced decision is made a V/UV decision circuit.

8 Claims, 7 Drawing Sheets

VOICED/UNVOICED DECISION USING A PLURALITY OF SIGMOID-TRANSFORMED PARAMETERS FOR SPEECH CODING

BACKGROUND OF THE INVENTION

1. Field of the Invention

This invention relates to a method and apparatus for voiced/unvoiced decision for judging whether an input speech signal is voiced or unvoiced and a speech encoding method employing the method for voiced/unvoiced decision.

2. Description of the Related Art

There are presently known a variety of encoding methods for compressing audio signals, including both speech signals and acoustic signals, by exploiting statistical characteristics of the audio signals in the time domain and in the frequency domain and characteristics of the human hearing mechanism. These encoding methods may roughly be divided into encoding in the time domain, encoding in the frequency domain and analysis/synthesis encoding.

For encoding speech signals, decision information includes information as to whether the input speech signal is voiced or unvoiced. The voiced sound is the sound accompanying vibration of vocal chords, while the unvoiced sound is the sound not accompanying vibration of vocal chords.

In general, the process of deciding or discriminating the voiced (V) sound and the unvoiced (UV) sound (V/UV decision) is carried out by a method accompanying pitch extraction, according to which the unvoiced/voiced (V/UV) decision is made using, for example, peaks of the autocorrelation function as characteristics of periodicity/non-periodicity. However, since no effective decision can be given when the input sound is non-periodic but is a voiced sound, the energy of the speech signal or the number of zero-crossings, for example, are also used as other parameters.

Meanwhile, since the voiced/unvoiced (V/UV) decision is made conventionally by a decisive rule of executing a logical operation of the results of decision of the respective parameters, it is difficult to give comprehensive decision on the input parameters in their entirety. For example, under a rule which states: 'if the frame averaged energy is larger than a pre-set threshold value and the autocorrelation peak value of the residual is larger than a pre-set threshold value, the sound is voiced' the sound is not judged to be voiced if the frame averaged energy significantly exceeds the threshold value but the autocorrelation peak value of the residual is smaller even by a small amount than the threshold value.

In addition, a particular input speech is in need of a rule proper to it, such that, for accommodating all possible sorts of the input speech, a corresponding large number of rules need to be used, thus entailing complication.

On the other hand, the V/UV decision employing spectral similarity, that is results of band-based V/UV decision, used in, for example, multiband excitation encoding (MBE), presupposes correct pitch detection. In fact, however, it is extremely difficult to perform pitch detection correctly to a high precision.

SUMMARY OF THE INVENTION

It is therefore an object of the present invention to provide a method and apparatus for judging the voiced/unvoiced (V/UV) decision whereby respective input parameters for the voiced/unvoiced (V/UV) decision are comprehensively judged for enabling high-precision V/UV decision by a simplified algorithm.

According to the present invention, there is provided a method for judging whether an input speech signal is voiced or unvoiced including converting a parameter x for voiced/unvoiced judgment for the input speech signal by a sigmoid function g(x) represented by $$g(x)=A/(1+\exp(-(x-b)/a))$$

where A, a and b are constants, and effecting voiced/voiced decision using a parameter converted by this sigmoid function.

In this manner, the input parameters for voiced/unvoiced (V/UV) decision can be judged comprehensively thus achieving high-precision V/UV decision by a simplified algorithm.

The parameter x may be converted by a function g'(x) obtained by approximating the sigmoid function g(x) with a plurality of straight lines in order to make the voiced/unvoiced decision using the converted parameter. In this manner, parameter conversion can be achieved by a simplified processing operation without employing function tables or the like thus lowering the cost of the device and increasing the operating speed.

At least one of the frame-averaged energy of the input speech signal, normalized autocorrelation peak value, spectral similarity degree, number of zero crossings and the pitch period may be used as the parameter for voiced/unvoiced decision.

DESCRIPTION OF THE PREFERRED EMBODIMENTS

Figure 1:
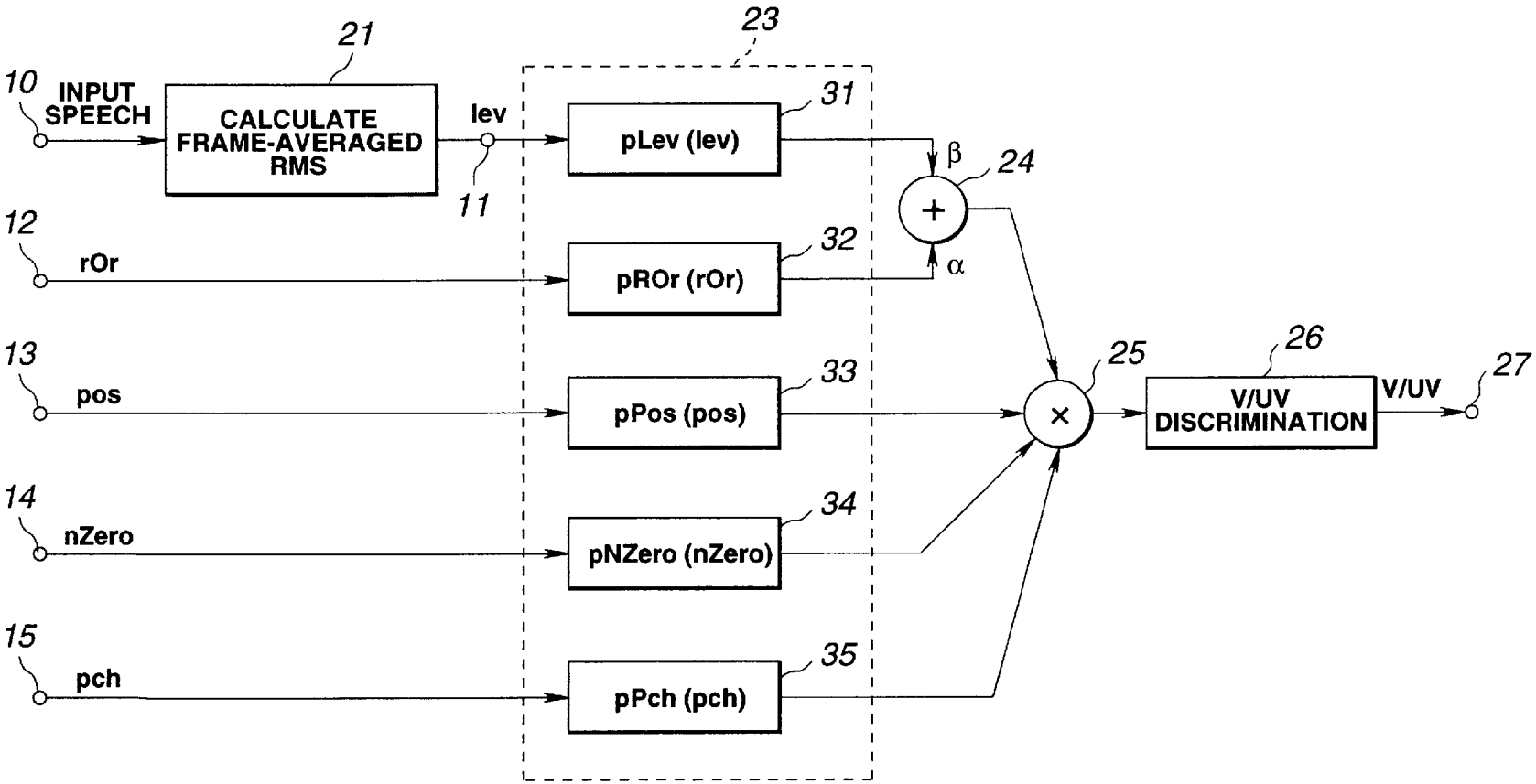
FIG. 1 is a block diagram showing the basic structure of a speech signal encoding device for carrying out the speech encoding method according to the present invention.

Referring to the drawings, preferred embodiments of the present invention will be explained in detail.

FIG. 1 shows an embodiment of a method for making the voiced/unvoiced (V/UV) decision according to the present invention.

Referring to FIG. 1, there are shown input terminals 11 to 15, to which are respectively supplied, as input parameters for making voiced/ unvoiced (V/UV) decision, a frame-averaged energy lev of the input speech signal, a normalized autocorrelation peak value r0r, the degree of specrtral similarity, the number of zero-crossings nZero and the pitch lag pch, respectively. The frame-averaged energy lev can be obtained by supplying the input speech signal from a terminal 10 to a frame averaged root mean squares (rms) calculating circuit 21. This frame-averaged energy lev is an average rms per frame or an equivalent value. Other input parameters will be explained subsequently.

The input parameters for V/UV decision are generalized so that, if the n input parameters, where n is a natural number, are denoted x1, x2,, . . . , xn, the degrees of semblance to the voiced (V) sound for these input parameters xk, where k=1, 2, . . . , n, is denoted by functions gk(xk), and the ultimate semblance to the voiced (V) sound is evaluated as $$f(x1, x2, , \ldots, xn)=F(g1(x1), g2(x2), \ldots, gn(xn))$$

The above functions gk(xk), where k=1, 2, . . . n, may be optional functions whose ranges assume values of from ck to dk, where ck and dk are constants such that ck<dk.

The above functions gk(xk), where k=1, 2, . . . , n, may also be continuous functions having different gradients and whose ranges assume values of from ck to dk.

The above functions gk(xk), where k=1, 2, . . . , n, may also be functions composed of plural straight lines having different gradients and whose ranges assume values of from ck to dk.

The above function gk(xk) may be sigmoid functions given by $$gk(xk)=Ak/(1+\exp(-(xk-bk)/ak)$$

where k=1, 2, . . . , n and Ak, ak and bk are constants differing with the input parameters xk;

or combinations by multiplication thereof.

The above sigmoid functions gk(xk)or combinations by multiplication thereof may also be approximated by plural straight lines having different gradients.

The input parameters may be enumerated by the above-mentioned frame averaged mean energy lev of the input speech signal, normalized autocorrelation peak value r0r, degree of similarity pos, the number of zero-crossings nZero and the pitch lag pch.

If the functions representing semblance to the ultimate voiced (V) sound of these input parameters lev, r0r, pos, nZero and pch are represented as pLev(lev), pR0R(r0r), pPos(pos), pNZero(nZero) and pPch(pch), respectively, the functions representing the ultimate semblance to the voiced (V) sound may be calculated by $$f(lev, r0r, pos, nZero \text{ and } pch) = ((\alpha pR0r(r0r) + \beta pLev(lev))/(\alpha + \beta)) \times pPos(pos) \times pNZero(nZero) \times pPch(pch)$$

where α and β are constants for appropriately weighting pR0R and pLev, respectively.

Referring to FIG. 1, the frame averaged mean energy lev of the input speech signal, normalized autocorrelation peak value r0r, degree of similarity pos, number of zero-crossings nZero and the pitch lag pch from the input terminals 11, 12, 13, 14 and 15, as input parameters, respectively, are sent to a calculation unit 23 for calculating the function representing semblance to the voiced (V) speech based on the frame-averaged mean energy lev of the input speech signal by a function calculating circuit 31. The function pR0R(r0r) representing resemblance to the voiced (V) sound based on the normalized autocorrelation peak value r0r is calculated by function calculating circuit 32. The function pR0R(r0r) pPos(pos) representing resemblance to the voiced (V) sound based on the degree of specrtral similarity pos is calculated by function calculating circuit 33. The function pNZero (nZero) representing the semblance to the voiced (V) sound based on the number of zero crossings nZero is calculated by a function calculation circuit 34, while the function pPch (pch) representing the semblance to the voiced (V) sound based on the pitch lag pch is calculated by a function calculating circuit 35. The illustrative calculations by these function calculation circuits 33 to 35, which will be explained subsequently, preferably use the above-mentioned sigmoid functions.

The output values of the functions pLev(lev) from the function calculation circuit 31 are multiplied by constants β, α and the resulting products are summed together at an adder 24. An addition output αpR0R(r0r)+βpLev(lev) of the adder is sent to a multiplier 25. The respective functions pPos(pos), pNZero(nZero) and pPch(pch) from these function calculation circuits 33 to 35 are sent to the multiplier 25 for multiplication for finding functions f(lev, r0r, pos, nZero and pch) representing the ultimate semblance to the voiced (V) sound of the above equation. These functions are sent to a V/UV (voiced/unvoiced) decision circuit 26 for discrimination at a pre-set threshold value for making V/UV decision for outputting a decision output at an output terminal 27.

Figure 2:
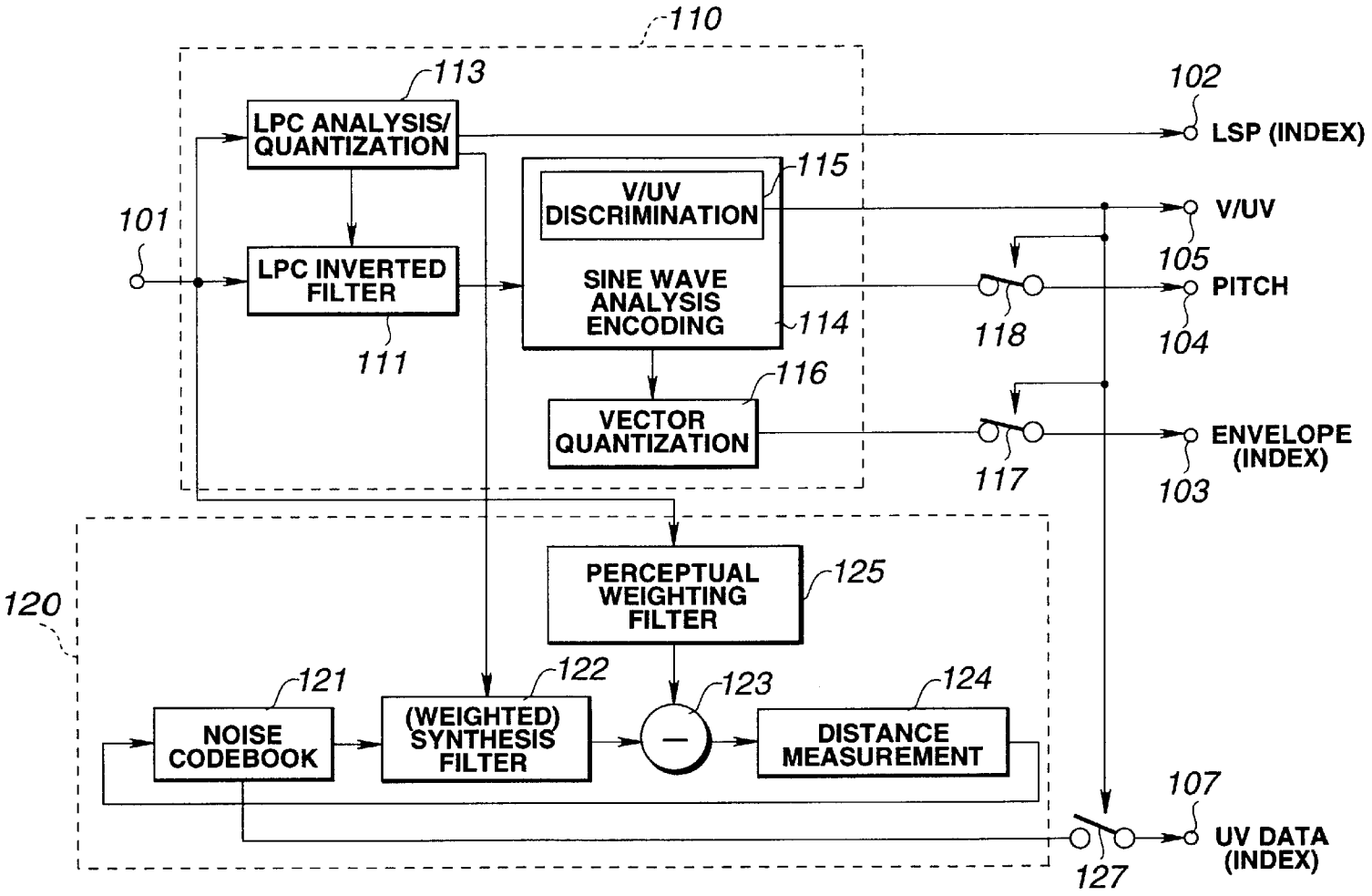
FIG. 2 is another block diagram showing the basic structure of a speech signal encoding device for carrying out the speech encoding method according to the present invention.

FIG. 2 shows a basic structure of a speech signal encoding device for carrying out the speech encoding method of the present invention employing the above-described discrimination method for discriminating the voiced/unvoiced speech as described above.

The basic concept of the speech signal encoding device shown in FIG. 2 is that the device includes a first encoding unit 110 and a second encoding unit 120, and that the first encoding unit 110 finds residuals of short-term prediction residuals, such as residuals of LPC (linear predictive coding) of the input speech signals for executing sinusoidal analysis encoding, such as harmonic coding, while the second encoding unit 120 encodes the input speech signals by waveform coding by waveform transmission. The first encoding unit 110 is used for encoding the voiced (V) portion of the input speech signal, while the second encoding unit 120 is used for encoding the unvoiced (UV) portion of the input speech signals. For making voiced/unvoiced (V/UV) decision of the present device, the above-described method and device for V/UV decision according to the present invention are employed.

For the encoding unit 110, the configuration for executing the sinusoidal analysis encoding on the LPC residuals, such as harmonic encoding r multiband encoding (MBE), is used. For the second encoding unit 120, the configuration for encoding by code excited linear prediction (CELP) employing vector quantization by closed loop search of optimum vector using synthesis by analysis method is employed.

In the example of FIG. 2, the speech signals sent to the input terminal 101 are sent to an LPC inverted filter Ill and to an LPC analysis quantization unit 113 of the first encoding unit 110. The LPC coefficients or so-called α-parameters produced from the LPC analysis quantization unit 113 are sent to the LPC inverted filter 111 from which linear prediction errors (LPC residuals) of the input speech signals are taken out. From the LPC analysis quantization unit 113, a quantized output of linear spectral pairs (LSPs) is taken out, as later explained, and is sent to an output terminal 102. The LPC residuals of the LPC residuals are sent to a sinusoidal analysis encoding unit 114. The sinusoidal analysis encoding unit 114 performs pitch detection or calculations of amplitudes of the spectral envelope and V/UV decision by a voiced (V)/unvoiced (UV) decision unit 115. For this V/UV decision unit 115, the above-described V/UV decision device shown in FIG. 1 is employed.

The spectral envelope amplitude data from the sinusoidal analysis encoding unit 114 is sent to a vector quantization unit 116. The codebook index from the vector quantization unit 116, as a vector-quantized output of the spectral envelope, is sent via a switch 117 to an output terminal 103, while an output of the sinusoidal analysis encoding unit 114 is sent via a switch 118 to an output terminal 105. The V/UV decision output of the V/UV decision unit 105 is sent to the output terminal 105, while being also sent as the control signals for the switches 117, 118. For the voiced (V) speech, the above index and the pitch are selected and outputted at the output terminals 103, 104.

In the present embodiment, the second encoding unit 120 of FIG. 2 has a code excited linear prediction (CELP) encoding configuration, and operates for synthesizing an output of the noise codebook 121 by a weighed synthesis filter 122, sending the obtained weighted speech to a subtractor 123, taking out an error from the speech obtained on passing the speech signal supplied to the input terminal 101 through a perceptually weighting filter 125, sending the error to a distance calculation circuit 124 for carrying out distance calculations and for searching the vector minimizing the error by the noise codebook 121. That is, the time-domain waveform is vector-quantized using a closed loop search by analysis by synthesis. This CELP encoding is used for encoding the unvoiced portion as described above. The codebook index as the UV data from the noise codebook is taken out at the output terminal 107 via a switch 127 which is turned on if the V/UV decision output of the V/UV decision unit 105 is UV (unvoiced).

Figure 3:
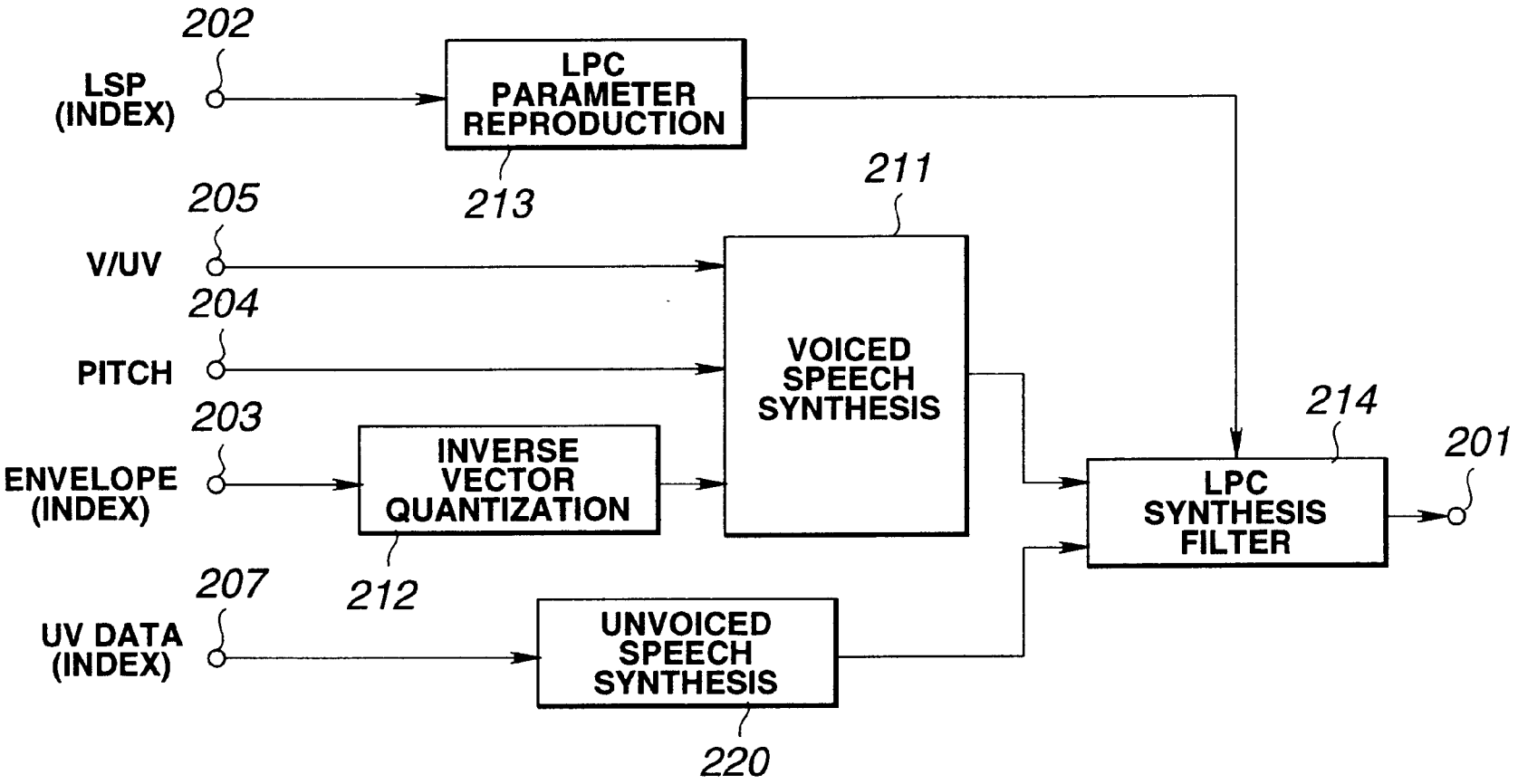
FIG. 3 is a block diagram showing the basic structure of a speech signal decoding device as a counterpart of the speech signal decoding device shown in FIG. 2.

FIG. 3 shows, in a block diagram, the basic structure of a speech signal decoding device which is a counterpart to the device shown in FIG. 2.

Referring to FIG. 3, a codebook index, as a quantized output of the linear spectral pairs (LSPs) from the output terminal 102 of FIG. 2, is sent to an input terminal 202. To input terminals 203, 204 and 205 are supplied outputs of the output terminals 103, 104 and 105 of FIG. 2, that is the index, pitch and the V/UV decision outputs as envelope quantized outputs, respectively. To an input terminal 207 is supplied the index as data for the unvoiced (UV) speech from the output terminal 107 of FIG. 2.

The index as the quantized envelope output from the input terminal 203 is sent to an inverse vector quantizer 212 for inverse vector quantization. The spectral envelope of the LPC residuals are found and sent to a voiced speech synthesis unit 211. The voiced speech synthesis unit 211, where the LPC (linear prediction encoding) residuals are synthesized by sinusoidal synthesis, are also fed with the pitch and the V/UV decision output from the input terminals 204, 205, respectively. The LPC residuals of the voiced speech from the voiced speech synthesis unit 211 are sent to an LPC synthesis filter 214. The index of the UV data from an input terminal 207 is sent to an unvoiced speech synthesis unit 220 where reference is made to the noise codebook in order to take put the LPC residuals of the unvoiced speech portion. These LPC residuals are also sent to the LPC synthesis filter 214. The LPC synthesis filter 214 effects LPC synthesis of the residuals of the voiced speech portion and the LPC residuals of the unvoiced speech portion independently of each other. The LPC synthesis may also be carried out on the LPC residuals and the LPC residuals of the unvoiced speech portion summed together. The index of the LSPs from the input terminals 202 is sent to the LPC parameter reproducing unit 213 where the α-parameters of the LPC are taken out and sent to the LPC synthesis filter 214. The speech signals obtained on LPC synthesis by the LPC synthesis filter 214 are taken out at the output terminal 201.

Figure 4:
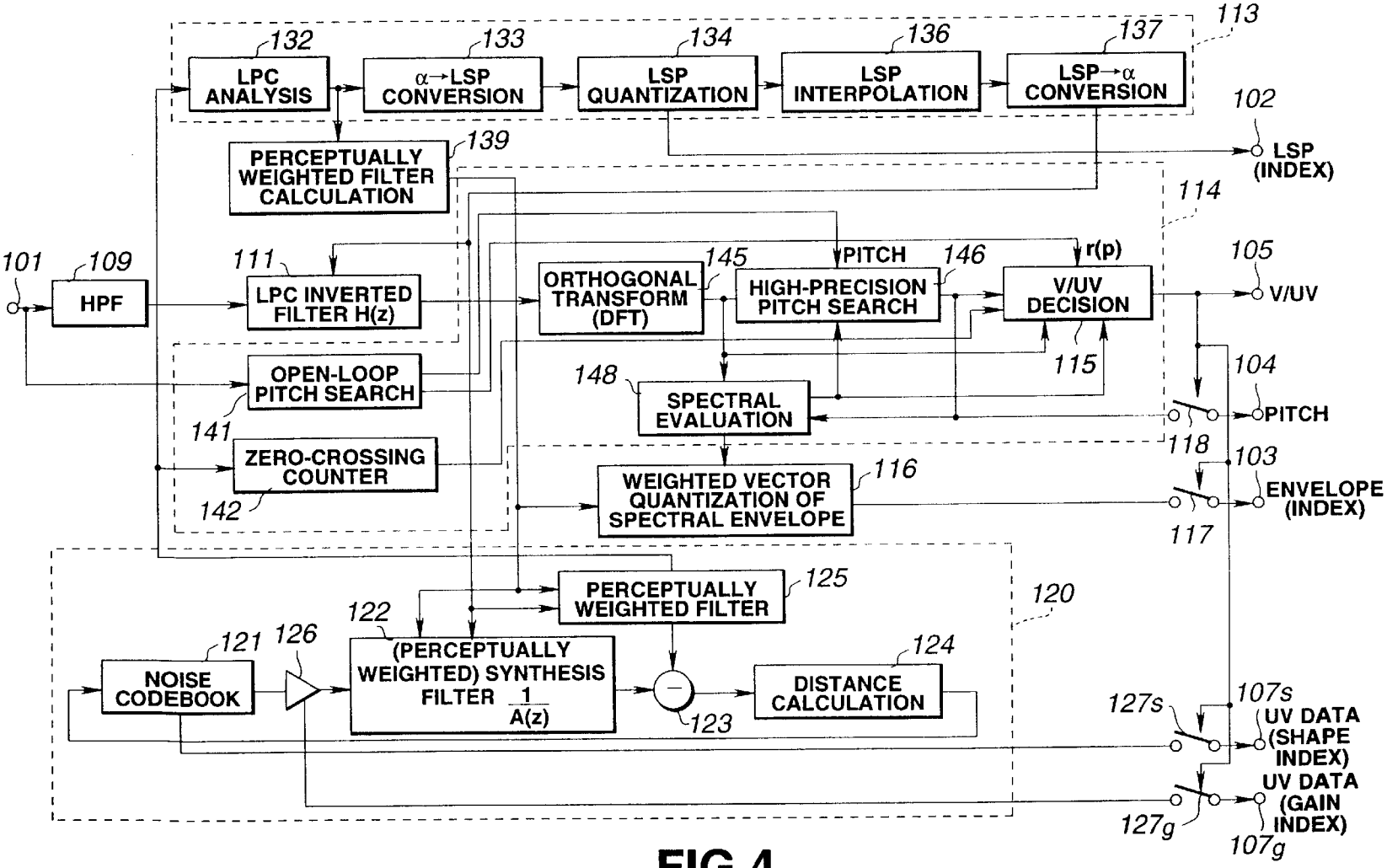
FIG. 4 is a block diagram showing the more detailed basic structure of a speech signal encoding device for carrying out the speech encoding method according to the present invention.

Referring to FIG. 4, a more detailed structure of the speech signals encoding device shown in FIG. 2 is explained. In FIG. 4, the parts or components corresponding to those of FIG. 2 are depicted by the same reference numerals.

In the speech signal encoding device shown in FIG. 4, the speech signals supplied to an input terminal 101 are filtered by a high-pass filter (HPF) 109 for removing unneeded band signals, and thence supplied to an LPC analysis circuit 132 of an LPC (linear predictive coding) analysis quantization unit 113 and to an LPC inverted filter circuit 111.

The LPC analysis circuit 132 of the LPC analysis quantizer 113 applies a Hamming window to the input signal waveform with a 16-sample length thereof as one block in order to find linear prediction coefficients, or so-called α-parameters, by the autocorrelation method. The framing interval as data outputting unit is of the order of 160 samples. If the sampling frequency fs is 8 kHz, for example, the frame interval is 20 msec in 160 samples.

The α-parameters from the LPC analysis quantizer 132 are sent to an α-LSP conversion circuit 133 for conversion into linear spectral pair (LSP) parameters. This converts the α-parameters found by the direct type filter coefficients into, for example, ten, that is five pairs of the LSP parameters. This conversion is carried out by, for example, the Newton-Rhapson method. Conversion to the LSP parameters is preferred since the LSP parameters are superior to α-parameters in interpolation characteristics.

The LSP parameters from the α-LSP conversion circuit 133 are matrix- or vector-quantized by an LSP quantizer 134. The frame-to-frame difference may first be taken before vector quantization or plural frames may be grouped together before matrix quantization. In the present embodiment, 20 msec is used as one frame and two frames of the LSP parameters calculated every 20 msec are quantized by matrix- or vector-quantization.

The quantized output of the LSP quantizer 134, that is LSP quantized index, are taken out at a terminal 102. The quantized LSP vector is sent to an LSP interpolation circuit 136.

The LSP interpolation circuit 136 interpolates the LSP vector quantized every 20 msec or every 40 msec to provide an eightfold rate. That is, the LSP vector is quantized every 2.5 msec. The reason is that, if the residual waveform is analysis-synthesized by the harmonic encoding/decoding method, the synthesized waveform presents an extremely smooth envelope waveform, so that, if the LPC coefficients are varied acutely every 20 msec, extraneous sounds tend to be produced. The extraneous sound may be prevented from being produced by having the LPC coefficients varied gradually every 2.5 msec.

For executing inverted filtering on the input speech signals using the interpolated 2.5 msec based LSP vectors, the LSP parameters are converted by an LSP-to-conversion circuit 137 into α-parameters which are coefficients of the direct type filter of, for example, 10 orders. An output of the LSP-to-α conversion circuit 137 is sent to the inverted LPC filtering circuit 111 which then effects inverted filtering by α-parameters updated every 2.5 msec for producing a smooth output. An output of the LPC inverted filtering circuit 111 is sent to a sinusoidal analysis encoding circuit 114, specifically an orthogonal transform circuit 145, such as a discrete Fourier transform circuit, of the harmonic encoding circuit 114.

The α-parameters from the LPC analysis circuit 132 of the LPC analysis quantization unit 113 are sent to a perceptual weighting filter calculation circuit 139 where data for perceptual weighting are found. These weighting data are sent to a perceptual weighting vector quantizer 116 as later explained and to the perceptual weighting filter 125 and the perceptually weighted synthesis filter 122 of the second encoding unit 120.

The sinusoidal analysis encoding unit 114 of the harmonic encoding circuit analyzes the output of the LPC inverted filtering circuit 111 by the harmonic encoding method. That is, the sinusoidal analysis encoding unit 114 detects the pitch, calculates the amplitude of each harmonics Am and judges the voiced (V)/unvoiced (UV) in order to provide a constant number of the envelope or amplitude of the harmonics changed with the pitch by dimensional conversion.

In the specified example of the sinusoidal analysis encoding unit 114 shown in FIG. 4, general harmonic encoding is presupposed. In particular, in the case of the multiband excitation coding (MBE), modeling is carried out on the assumption that there exist a voiced portion and an unvoiced portion in each frequency band of the same time instant (same block or frame), that is, from one frequency band to another. In other harmonic encoding, the speech within one block or frame is alternatively judged as to whether the speech in the frame or block is voiced or unvoiced. In the following description, the frame-based V/UV applied to the MBE encoding means that a given frame is judged to be UV if all bands are UV.

To an open loop pitch search unit 141 of the sinusoidal analysis encoding unit 114 is supplied the input speech signal from the input terminal 101. To a zero-crossing counter 142 is supplied a signal from a high-pass filter (HPF) 109. To an orthogonal transform circuit 145 of the sinusoidal analysis encoding unit 114 are supplied the LPC residuals or linear prediction residuals from the LPC inverted filter 111. The open-loop pitch search unit 141 takes LPC residuals of the input signal with a rougher pitch of the open loop. The extracted rough pitch data is sent to a high pitch search 146 for carrying out high precision pitch search by the closed loop (fine pitch search). From the open loop pitch search unit 141, the normalized maximum autocorrelation value r(p), obtained on normalizing the maximum value of the autocorrelation of the LPC residuals, are taken out along with the rough pitch data, and sent to the V/UV (voiced/unvoiced) decision unit 115.

The orthogonal transform circuit 145 executes orthogonal transform, such as discrete Fourier transform, for transforming the time-domain LPC residuals into frequency-domain spectral amplitude data. An output of the orthogonal transform circuit 145 is sent to a high-precision pitch search unit 146 and to a spectral evaluation unit 148 for evaluating the spectral amplitude or the envelope.

To a high-precision (fine) pitch search unit 146 are sent rougher pitch data extracted by the open loop pitch search unit 141 and frequency-domain data DFTed by the orthogonal transform unit 145. The fine pitch search unit 146 swings pitch data, with the rough pitch data value as the center, by ± several samples by 0.2 to 0.5 at a time for driving to fine pitch data value with an optimum decimal point (floating). The fine pitch search technique is to use a so-called analysis by synthesis method in order to select the pitch so that the synthesized power spectrum will be closest to the power spectrum of the original sound. The pitch data from the high-precision pitch search unit 146 by the closed loop is sent via the switch 118 to the output terminal 104.

The spectral evaluation unit 148 evaluates the amplitude of each harmonics and the spectral envelope as an assembly of the amplitudes, based on the spectral amplitude and the pitch as the orthogonal transform output of the LPC residuals, and sends the result of evaluation to the high-precision pitch search unit 146, V/UV (voiced/unvoiced) decision unit 115 and the perceptual weighted vector quantizer 116.

The V/UV (voiced/unvoiced) decision unit 115 performs V/UV decision of a given frame based on an output of the orthogonal transform circuit 145, an optimum pitch from the high-precision pitch search unit 146, spectral amplitude data from the spectral evaluation unit 148, normalized maximum autocorrelation value r(p) from the open loop pitch search unit 141 and the zero-crossing count value from the zero-crossing counter 142. The boundary position of the results of V/UV decision from band to band in case of MBE may also be used as a condition of the V/UV decision for the frame. The decision output of the V/UV decision unit 115 is taken out at an output terminal 105.

In an output portion of the spectral evaluation unit 148 or in an input portion of the vector quantizer 116 is provided a data number conversion unit which is a sort of the sampling rate conversion unit. The function of the data number conversion unit is to provide a constant number of the amplitude data |Am| of the envelope in consideration that the number of band division on the frequency axis and hence the number of data are varied with the pitch. That is, if the effective band is up to 3400 kHz, the effective band is divided into 8 to 63 bands depending on the pitch so that the number mMx+1 of the amplitude data |Am| obtained from band to band is varied in a range of from 8 to 63. Thus the data number conversion unit 119 converts the amplitude data of the variable number mMx+1 into a constant number M, such as 44.

The above constant number M, such as 44, of amplitude data or envelope data, from the data number conversion unit provided in the output portion of the spectral evaluation unit 148 or in the input portion of the vector quantizer 116, are collected by the vector quantizer 116 into groups each made up of a pre-set number of data, such as 44 data, to form vectors, which are then processed with weighted vector quantization . The weighting is supplied by an output of the perceptual weighting filter calculation circuit 139. The index of the above envelope from the vector quantizer 116 is taken out via a switch 117 at an output terminal 103. Prior to the above-mentioned weighted vector quantization, a frame-to-frame difference employing an appropriate leak coefficient may be taken of a vector made up of a pre-set number of data.

The second encoding unit 120 is now explained. The second encoding unit 120 has a so-called code excited linear prediction (CELP) encoding configuration and is used in particular for encoding the unvoiced portion of input speech signals. In the CELP encoding configuration for the unvoiced speech portion, the noise output equivalent to the LPC residuals of the unvoiced speech, which is a representative value output of the so-called stochastic codebook 121, is sent via gain control circuit 126 to a perceptually weighted synthesis filter 122. The perceptually weighted synthesis filter 122 then LPC-synthesizes the input noise to produce a weighted unvoiced speech signal which is sent to a subtractor 123. The subtractor 123 is fed with the speech signal which is supplied from the input terminal 101 via HPF 109 and which is perceptually weighted by the perceptual weighting filter 125 so that a difference or error between the signal from the synthesis filter 122 and the signal from the filter 125 is taken out and sent to the distance calculation circuit 124 to carry output distance calculations. The representative value vector which minimizes the error is searched by the noise codebook 121. In this manner, the time-domain waveform is vector-quantized using a closed loop search employing the analysis by synthesis method.

As the data for the unvoiced (UV) portion from the second encoding unit 120 employing the CELP coding configuration, the shape index of the codebook from the noise codebook 121 and the gain index of the codebook from the gain circuit 126 are taken out. The shape index as the UV data from the noise codebook 121 is sent via switch 127*s* to an output terminal 107*s*, while the gain index as the UV data of the gain circuit 126 is sent via switch 127*g* to an output terminal 107*g*.

The switches 127*s*, 127*g* and the switches 117, 118 are on/off controlled based on the result of V/UV decision from the V/UV decision unit 115. The switches 117, 118 are turned on if the result of V/UV decision of the speech signal of the frame currently transmitted is voiced (V), while the switches 127*s*, 127*g* are turned on if the result of V/UV decision of the speech signal of the frame currently transmitted is unvoiced (UV).

An illustrative example of the V/UV (voiced/unvoiced) decision unit 115 of the speech signal encoding device of FIG. 4 is now explained.

The V/UV decision unit 115 has the above-described V/UV decision device of FIG. 1 as the basic configuration and performs V/UV decision on a frame based on the frame-averaged energy lev of the input speech signal, normalized autocorrelation peak value r0r, spectral similarity degree pos, number of zero-crossings nZero and the pitch lag pch.

That is, the frame averaged energy, that is frame averaged rms or an equivalent value lev, of the input speech signal is found based on an output of the orthogonal transform circuit 145, and is supplied to an input terminal 11 of FIG. 1. The normalized autocorrelation peak value r0r from the open loop pitch search unit 141 is supplied to the input terminal 12 of FIG. 1. The value of zero-crossings nZero from the zero-crossing counter 142 is supplied to the input terminal 14 of FIG. 1. The pitch lag pch, representing the pitch period by the number of samples, is supplied to the input terminal 15 of FIG. 1 as an optimum pitch from the fine pitch search unit 146. The boundary position of the band-based results of V/UV decision, similar to that of the MBE, is also a condition for V/UV decision for the frame, and is supplied as the spectral similarity degree pos to the input terminal 13 of FIG. 1.

The spectral similarity degree pos as V/UV decision parameter employing the results of band-based V/UV decision for MBE is now explained.

The parameter specifying the size of the mth harmonics for MBE or the amplitude |Am| is given by $$|A_m| = \sum_{j=a_m}^{b_m} |S(j)||E(j)| \Big/ \sum_{j=a_m}^{b_m} |E(j)|^2$$

In the above equation, |S(j)| is the spectrum obtained by DFTing the LPC residuals, while |E(j)| is the spectrum of the base signal, specifically the spectrum obtained on DFTing the 256-point Hamming window. For band-based V/UV decision, the noise to signal ratio (NSR) is used. The NSR of the mth band is represented by:

$$NSR = \frac{\sum_{j=a_m}^{b_m} \{|S(j)| - |A_m||E(j)|\}^2}{\sum_{j=a_m}^{b_m} |S(j)|^2}$$

If the NSR value is larger than a pre-set threshold value, such as 0.3, that is if the error is larger, it may be judged that approximation of |S(j)| by |Am||E(j)| is not good, that is that the above excitation signal |E(j)| is not proper as base. In such case, the band is judged to be unvoiced (UV). Otherwise, it may be judged that approximation has been done fairly satisfactorily and hence the band is judged to be voiced (V).

Meanwhile, the number of bands divided by the basic pitch frequency (number of harmonics) is varied in a range from approximately 8 to 63 depending on the sound pitch and hence the number of V/UV flags is similarly varied from band to band. Thus, the results of V/UV decision are grouped, or degraded, for each of a pre-set number of bands obtained on dividing the spectrum by a fixed frequency band. Specifically, a pre-set frequency spectrum including the speech range is divided into, for example, 12 bands, for each of which the V/UV is judged. As for the band-based V/UV decision data, not more than one demarcating position or boundary position between the voiced (V) speech area and the unvoiced (UV) speech area in the totality of the bands is used as the spectral similarity degree pos. In this case, the spectral similarity degree pos can assume the value of $1 \leqq pos \leqq 12$.

The input parameters supplied to the input terminals 11 to 15 of FIG. 1 are sent to the function calculating circuits 31 to 35 for calculating the functional values representing the semblance to voiced (V) speech. Specific examples of the functions are hereinafter explained.

Figure 5:
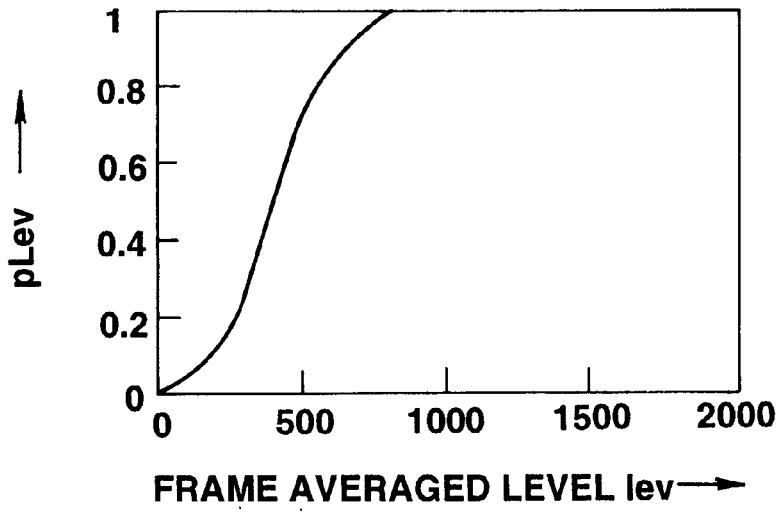
FIG. 5 is a chart showing an example of a function pLev(lev) indicating the degree of semblance to the voiced (V) speech with respect to the frame averaged energy lev of the input speech signal.

First, in the function calculation circuit 31 of FIG. 1, the value of the function pLev(lev) is calculated based on the value of the frame-averaged energy lev of the input speech signal. As the function pLev(lev), $$pLev(lev)=1.0/(1.0+\exp(-(lev-400.0)/100.0))$$

for example, is employed. FIG. 5 shows a graph for this function pLev(lev).

Figure 6:
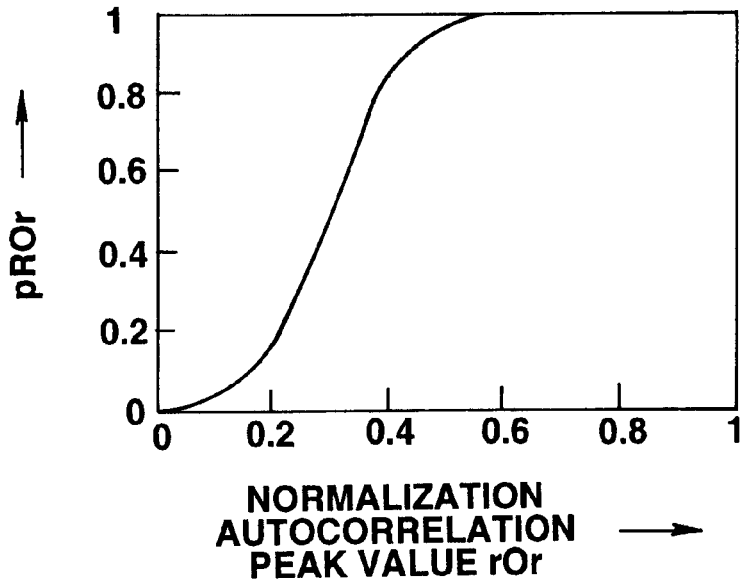
FIG. 6 is a chart showing an example of a function pR0R(r0r) indicating the degree of semblance to the voiced speech with respect to the normalized autocorrelation peak value r0r.

Next, in the function calculation circuit 32 of FIG. 1, the value of the function pR0R(r0r) is calculated based on the value of the normalized autocorrelation peak value r0r signal ($0 \leqq r0r \leqq 1.0$. As the function pR0R(r0r), $$pR0R(r0r)=1.0/(1.0+\exp(-(r0r-0.3)/0.06))$$

for example, is employed. FIG. 6 shows a graph for this function pR0R(r0r).

Figure 7:
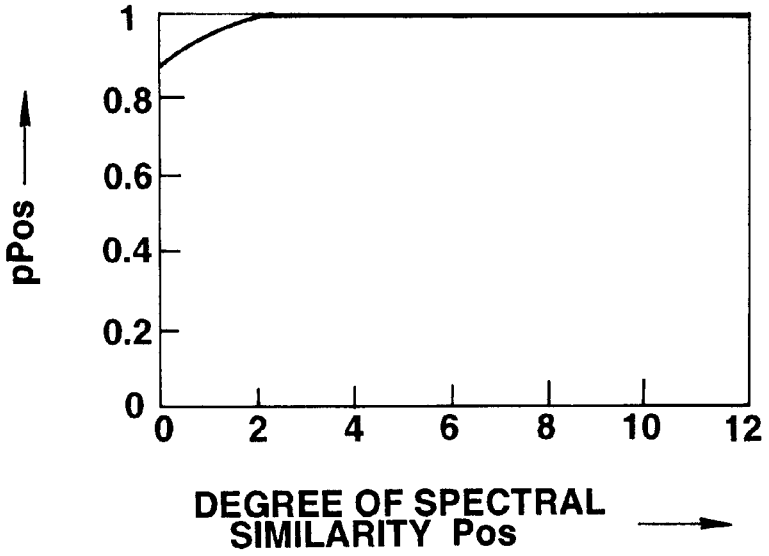
FIG. 7 is a chart showing an example of a function pPos(pos) indicating the degree of semblance to the voiced speech with respect to the degree of spectral similarity pos.

In the function calculation circuit 33 of FIG. 1, the value of the function pPos(pos) is calculated based on the value of the spectral similarity degree pos ($0 \leqq pos \leqq 1.0$). As the function pPos(pos), $$pPos(pos)=1.0/(1.0+\exp(-(pos-1.5)/0.8))$$

for example, is employed. FIG. 7 shows a graph for this function pPos(pos).

Figure 8:
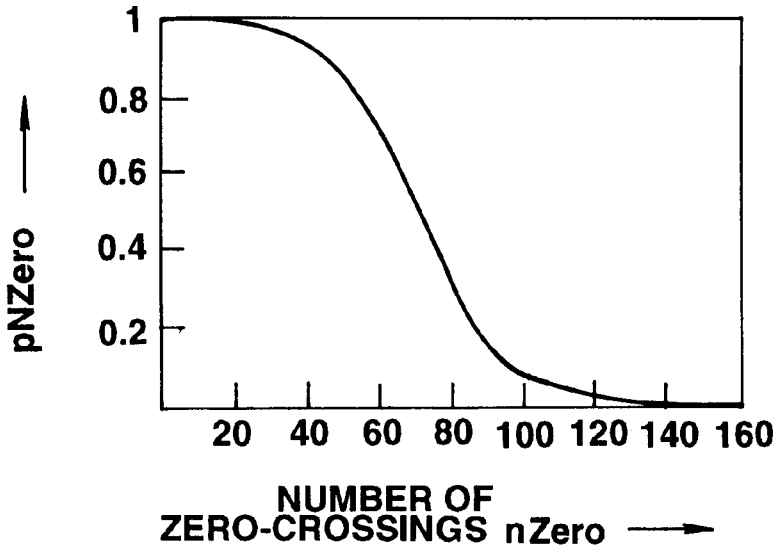
FIG. 8 is a chart showing an example of a function pNZero(nZero) indicating the degree of semblance to the voiced speech with respect to the number of zero-crossings nZero.

In the function calculation circuit 34 of FIG. 1, the value of the function pNZero(nZero) is calculated based on the value of the number of zero-crossings nZero ($1 \leqq nZero \leqq 160$). As the function pNZero(nZero), $$pNZero(nZero)=1.0/(1.0+\exp((nZero-70.0)/12.0))$$

for example, is employed. FIG. 8 shows a graph for this function pNZero(nZero).

Figure 9:
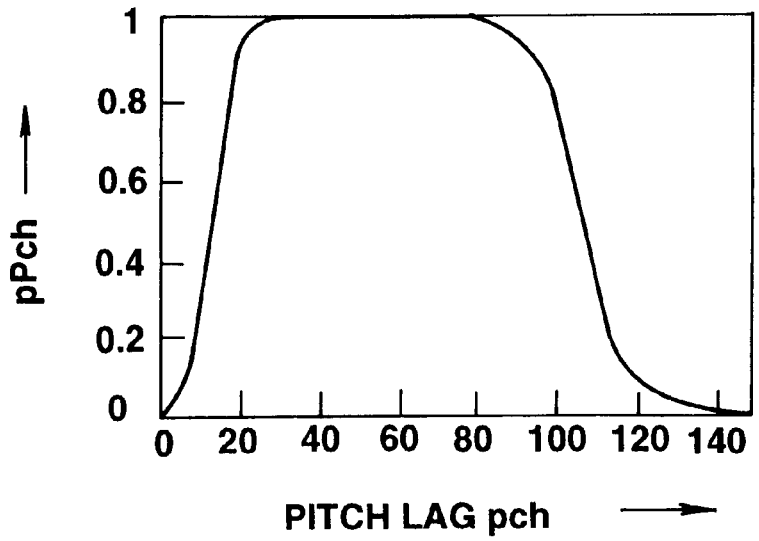
FIG. 9 is a chart showing an example of a function pPch(pch) indicating the degree of semblance to the voiced speech with respect to the pitch lag pch.

In the function calculation circuit 35 of FIG. 1, the value of the function pPch(pch) is calculated based on the value of the number of pitch lag pch ($20 \leqq pch \leqq 147$). As the function pPch(pch), $$pPch(pch)=1.0/(1.0+\exp(-(pch-12.0)/2.5))\times 1.0/(1.0+\exp((pch-105.0)/6.0))$$

for example, is employed. FIG. 9 shows a graph for this function pPch(pch).

Using semblance to voiced (V) sound concerning the parameters lev, r0r, pos, nZero and pch calculated by these functions pLev(lev), pR0R(r0r), pNZero(nZero) and pPch (pch), the ultimate semblance to V is calculated. In this case, the following two points are preferably taken into account.

First, if the autocorrelation peak value is smaller but the frame averaged energy is extremely large, the speech should be judged to be voiced (V). Thus, for parameters exhibiting strong complementary relation, a weighted sum is taken. Second, parameters representing semblance to V independently are multiplied by each other.

Therefore, the autocorrelation peak value and the frame averaged energy exhibiting a complementary relation to each other are summed together with weighting and those not showing this relation are multiplied with each other. The functions f(lev, r0r, pos, nZero, pch) representing the ultimate semblance to V are calculated by $$f(lev, r0r, pos, nZero, pch) = ((1.2pR0r)(r0r) + 0.8lLev(lev))/(2.0)\times pPos(pos)\times pNZero(nZero)\times pPch(pch)$$

where the weighting parameters ($\alpha$=1.2, $\beta$=0.8) are obtained empirically.

In giving ultimate decision on voiced/unvoiced (V/UV), the speech is decided to be V and UV if the function f is not less than 0.5 and smaller than 0.5, respectively.

Figure 10:
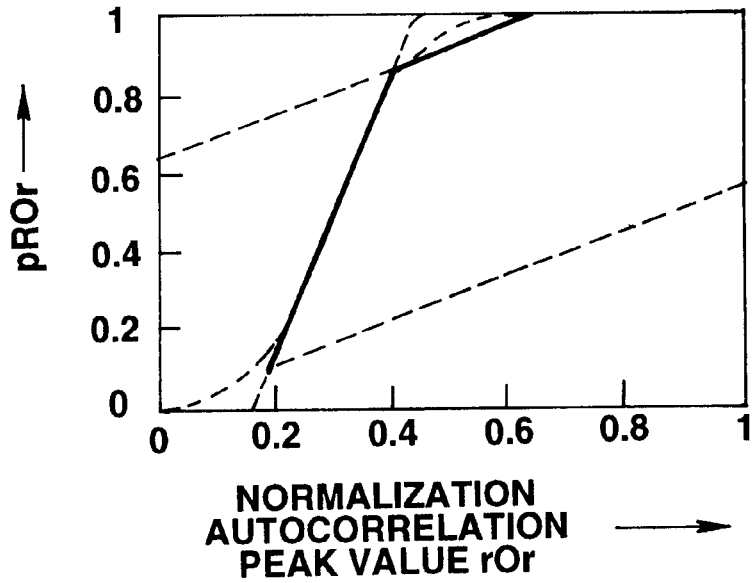
FIG. 10 is a chart showing an example of a function pR0R' representing the semblance to the voiced speech with respect to the normalized autocorrelation peak value r0r.

The present invention is not limited to the above-described embodiments. For example, in place of the above functions pR0R(r0r) for finding semblance to V in connection with the normalized autocorrelation peak value r0r, the following functions:

$$pR0R'(r0r)=0.6x,\ 0 \leqq x,\ 7/34$$

$$pR0R'(r0r)=4.0(x-0.175),\ 7/34 \leqq x < 67/170$$

$$pR0R'(r0r)=0.6x+0.64,\ 67/170 \leqq x < 0.6$$

$$pR0R'(r0r)=1,\ 0.6 \leqq x \leqq 1.0$$

may b used as a function pR0R'(r0r) approximating the above functions pR0R(r0r). The graph of the approximating function pR0R'(r0r) is shown by a solid line of FIG. 10, in which a broken line denotes approximating straight lines and the original functions pR0R(r0r).

Although the structure of the speech analysis side (encoding side) is shown as hardware, it may be implemented by a software program using a so-called digital signals processor (DSP). As the speech encoding method employing the V/UV decision f the present invention, the LPC residual signals may be divided into V and UV to which different encoding techniques may be applied. That is, speech compression encoding or encoding the residues by harmonic coding or sinusoidal analysis encoding may be used on the V side, while a variety of encoding techniques, such as CELP encoding or encoding employing synthesis of the noise by noise coloring may be applied to the UV side. In addition, the LPC residues may be encoded on the V side, while the speech compression encoding system of carrying out the variable dimension weighted vector quantization may be applied to the spectral envelope. Moreover, the present invention may be applied not only to speech compression encoding systems, but may be applied to a wide variety of fields of application, such as pitch conversion, rate conversion, speech synthesis by rule or noise suppression.

What is claimed is:

1. A method for judging whether an input speech signal is voiced or unvoiced, comprising the steps of:

calculating a plurality of functional values representing semblance to voiced speech of each of a plurality of parameters representing a characteristic of the input speech signal, wherein at least one of the plurality of functional values is calculated by converting a parameter x for voiced/unvoiced decision by a sigmoid function g(x) represented by $$g(x)=A/(1+\exp(-(x-b)/a)),$$

where A, a, and b are constants differing with each input parameter x, which represents a characteristic of the input speech signal; and effecting voiced/voiced decision based on the plurality of functional values weighted by weighting coefficients.

2. The method for judging whether an input speech signal is voiced or unvoiced as claimed in claim 1, wherein the parameter x is converted by a function g'(x) obtained by approximating the sigmoid function g(x) by a plurality of straight lines, and the voiced/unvoiced decision is made using a result of converting the parameter x by the function g'(x).

3. The method for judging whether an input speech signal is voiced or unvoiced as claimed in claim 1, wherein at least one of a frame-averaged energy of the input speech signal, a normalized autocorrelation peak value, a spectral similarity degree, a number of zero crossings, and a pitch period is used as the parameter x for voiced/unvoiced decision.

4. The method for judging whether an input speech signal is voiced or unvoiced, comprising the steps of:

converting a parameter x for voiced/unvoiced decision by a sigmoid function g(x) represented by $$g(x)=A/(1+\exp(-(x-b)/a)),$$

where A, a, and b are constants and the parameter x represents a characteristic of the input speech signal; and effecting voiced/voiced decision using a result of converting the parameter by the sigmoid function g(x), wherein parameters for the voiced/unvoiced decision include a frame-averaged energy of the input speech signal lev, a normalized autocorrelation peak value r0r, a spectral similarity degree pos, a number of zero crossings nZero, and a pitch lag pch, and if functions representing semblance to the voiced speech based on the parameters are respectively represented by pLev(lev), pR0R(r0r), pPos(pos), pNZero(nZero), and pPch(pch), a function f(lev, r0r, pos, nZero, pch) representing ultimate semblance to voiced speech employing the functions is represented by $$f(lev, r0r, pos, nZero, Pch) = ((\alpha pR0r(r0r) + \beta pLev(lev)/(\alpha + \beta)) \times pPos(pos) \times pNZero(nZero) \times pPch(pch),$$

where α and β are constants.

5. An apparatus for judging whether an input speech signal is voiced or unvoiced, comprising:

function calculation means for calculating a plurality of functional values representing semblance to voiced speech of each of a plurality of parameters representing a characteristic of the input speech signal, wherein at least one of the plurality of functional values is calculated by converting a parameter x for voiced/unvoiced decision by a sigmoid function g(x) represented by $$g(x)=A/(1+\exp(-(x-b)/a)),$$

where A, a, and b are constants differing with each input parameter x, which represents a characteristic of the input speech signal; and means for effecting voiced/unvoiced decision using the plurality of function values, obtained based on the sigmoid function g(x), output by the function calculation means.

6. A method for encoding an input speech signal in which the input speech signal is divided in terms of a frame as a unit in a time domain and encoded on a frame basis, comprising the steps of:

calculating a plurality of functional values representing semblance to voiced speech of each of a plurality of parameters representing a characteristic of the input speech signal, wherein at least one of the plurality of functional values is calculated by converting a parameter x for voice/unvoiced decision by a sigmoid function g(x) represented by $$g(x)=A/(1+\exp(-(x-b)/a)),$$

where A, a, and b are constants differing with each input parameter x, which represents a characteristic of the input speech signal;

effecting voiced/unvoiced decision based on the functional values weighted by weighting coefficients; and effecting sinusoidal analysis encoding on an input speech signal portion found to be voiced based on a result of the voiced/unvoiced decision.

7. The speech encoding method as claimed in claim 6, wherein the parameter x is converted by a function g'(x) obtained by approximating the sigmoid function g(x) by a plurality of straight lines, and the voiced/unvoiced decision is made using a result of converting the parameter x by the function g'(x).

8. The speech encoding method as claimed in claim 6, wherein, for an input speech signal portion found to be unvoiced based on a result of the voiced/unvoiced decision, a time-domain waveform is vector-quantized by a closed-loop search of an optimum vector using an analysis-by-synthesis method.

* * * * *